US005152268A

United States Patent [19]

Hendron et al.

[11] Patent Number: 5,152,268

[45] Date of Patent: Oct. 6, 1992

[54] THROTTLE CONTROL LINKAGE FOR INTERNAL COMBUSTION ENGINES AND METHOD OF SET-UP

[75] Inventors: Scott S. Hendron, Barrington; Norman E. Williams, Park Ridge, both of Ill.

[73] Assignee: Komatsu Dresser Company, Lincolnshire, Ill.

[21] Appl. No.: 762,421

[22] Filed: Sep. 19, 1991

[51] Int. Cl.[5] ..... F02D 11/02

[52] U.S. Cl. ..... 123/400; 74/491; 74/526; 74/501.6

[58] Field of Search ..... 74/491, 526, 501.6; 123/400, 399, 376, 339

[56] References Cited

U.S. PATENT DOCUMENTS

| | | | |
|---|---|---|---|
| 4,016,842 | 4/1977 | Kittler | 74/526 |
| 4,094,281 | 6/1978 | Kittler | 74/526 |
| 4,182,196 | 1/1980 | Glass | 74/491 |
| 4,445,394 | 5/1984 | Yapp et al. | 74/501.6 |
| 4,660,521 | 4/1987 | Higuchi et al. | 123/400 |
| 5,065,719 | 11/1991 | Panten et al. | 123/400 |

OTHER PUBLICATIONS

Dresser Parts Manual Model TD-15E Crawler Tractor Form PM-TD15E, pp. 12-016 and 12-018, Jan. 1987.

Technical Manual John Deere 455G, 555G Crawler Loader and 450G, 550G, 650G Crawler Bulldozer Repair, TM-1404, p. 0515-1, Nov. 1987.

Dresser Parts Manual Models TD7G TD8G 100G 125G Crawler Tractors Form 1128 200 H1, pp. 12-016, 12-017, and 12-019, Feb. 1988.

Dresser Parts Manual Model 200 Crawler Loader Form 1128 202 H1, pp. 12-018, and 12-019, Nov. 1988.

Dresser Parts Manual Model 175C Crawler Loader S/N 40740 and Up Form PMA 175C, pp. 12-016 and 12-017, Feb. 1989.

Komatsu D31E-18 Bulldozer Parts Book, pp. 4-2 and 4-3, Sep. 1990.

*Primary Examiner*—E. Rollins Cross
*Assistant Examiner*—M. Macy
*Attorney, Agent, or Firm*—Richards, Medlock & Andrews

[57] ABSTRACT

A method and apparatus for providing throttle control linkage for an internal combustion engine having a pivotally-mounted injector lever for movement between a first predetermined position and a second predetermined position to control a fuel injector pump is disclosed and comprises a throttle control lever mounted for movement between a first predetermined position and a second predetermined position, a pivotally-mounted bellcrank having an arcuate slot formed therein, first linkage structure operatively connected between the throttle control lever and the pivotally-mounted bellcrank and second linkage structure operatively connected between the arcuate slot and the pivotally-mounted injector lever. The arcuate slot is formed along a predetermined radius from the connection of the second linkage means on the pivotally-mounted injector lever when the throttle control lever and the pivotally-mounted injector lever are positioned in the first predetermined position. The method of setting up the throttle control linkage includes the steps of placing the throttle control lever in a first predetermined position, placing the injector lever in a first predetermined position, adjusting the length of the second linkage so the connecting end is moveably positioned in the arcuate slot of the pivotally-mounted bellcrank, placing the throttle control lever in a second predetermined position, placing the injector lever in a second predetermined position and clamping the connecting end of the second linkage in the arcuate slot of the pivotally-mounted bellcrank so the connecting end does not move along the arcuate slot.

12 Claims, 2 Drawing Sheets

THROTTLE CONTROL LINKAGE FOR INTERNAL COMBUSTION ENGINES AND METHOD OF SET-UP

TECHNICAL FIELD OF THE INVENTION

This invention relates generally to internal combustion engines. More particularly, but not by way of limitation, this invention relates to throttle control linkage for internal combustion engines.

BACKGROUND OF THE INVENTION

Although this invention is applicable to numerous and various types of linkages for throttle control of internal combustion engines, it has been found to be particularly useful in the environment of diesel engines for heavy vehicles. Therefore, without limiting the applicability of the invention to "throttle control linkage for internal combustion engines, particularly diesel engines", the invention will be described in such environment.

It is well known that in the manufacture of fuel injector pumps the amount of travel of the injector lever from the idle or low or LI position to the full throttle or high idle or HI position varies among fuel injector pumps of the same model. At the factory, a stop mechanism is located and locked at one end of the travel of the injector lever to designate the idle or low idle or LI position of the injector lever on the fuel injector pump. Another stop mechanism is located and locked at the other end of the travel of the injector lever to designate the full throttle or high idle or HI position of the injector lever on the fuel injector pump. The end of travel positions are determined based upon the required output specifications of the fuel injector pump at the two end positions. Unfortunately, these two end positions usually vary among different fuel injector pumps of the same model so the length of travel of the injector lever varies among the fuel injector pumps.

When a fuel injector pump is installed for operation with a diesel engine, the throttle control linkage must be operatively connected between the throttle control lever and the pivotally-mounted injector lever on the fuel injector pump. Earlier attempts to solve the problem of the variable length of injector lever travel among fuel injector pumps have resulted in two types of solutions.

One solution is to provide an adjustable stop on the throttle control lever. The linkage ratio or the ratio of the travel between the throttle control lever and the injector lever is made constant. The injector lever is positioned against the stop at the HI or full throttle position and the throttle control lever is positioned to its HI or full throttle position. All the links or portions of the throttle control linkage between the injector lever and the throttle control lever are operatively attached together to form a complete linkage. The throttle control lever is then moved toward its LI or low idle position until the injector lever hits the stop at its LI or low idle position. At this point, a physical stop 12 is installed to prevent any further motion of the throttle control lever 10 past the low idle position of the injector lever, as shown in FIG. 1. This results in the travel of the throttle lever being dependent upon and limited by the travel of the injector lever. Often, the resulting travel of the throttle control lever is too short for good control of engine speed.

Another solution provides for making the linkage ratio adjustable by placing several holes 14 (see FIG. 2) about some nominal location in one or more bellcranks 16 in the throttle control linkage. This may be accomplished at the throttle lever bellcrank or at some intermediate bellcrank. The additional holes 14 are located so as to give the expected range of linkage ratios required to account for injector lever travel variation. This particular solution requires that the linkage be connected using a nominal hole as a starting point. By trial and error, the hole giving the closest desired full travel of the injector lever is found. This type of linkage can only give incremental travel variations and requires disconnecting a link or portion of the throttle control linkage, adjusting the length of the link and reconnecting the linkage in a new hole for each trial and error iteration. Accurate adjustment of engine idle speed from LI to HI cannot always be made because only certain distinct ratio's are available as governed by the number and spacing of holes 14.

SUMMARY OF THE INVENTION

The present invention provides throttle control linkage for an internal combustion engine having a pivotally-mounted injector lever for movement between a first predetermined position and a second predetermined position to control a fuel injector pump and comprises a throttle control lever mounted for movement between a first predetermined position and a second predetermined position, a pivotally-mounted bellcrank having an arcuate slot formed therein, first linkage means operatively connected between the throttle control lever and the pivotally-mounted bellcrank and second linkage means operatively connected between the arcuate slot and the pivotally-mounted injector lever. The arcuate slot is formed along a predetermined radius from the connection of the second linkage means on the pivotally-mounted injector lever when the throttle control lever and the pivotally-mounted injector lever are positioned in the first predetermined position.

The method of setting up the throttle control linkage includes the steps of placing the throttle control lever in a first predetermined position, placing the injector lever in a first predetermined position, adjusting the length of the second linkage means so the connecting end is moveably positioned in the arcuate slot of the pivotally-mounted bellcrank, placing the throttle control lever in a second predetermined position, placing the injector lever in a second predetermined position and clamping the connecting end of the second linkage means in the arcuate slot of the pivotally-mounted bellcrank so the connecting end does not move along the arcuate slot.

Among the advantages offered by the present invention is that the full travel of the throttle control lever is always used regardless of the variations in the travel of the injector lever of the various fuel injector pumps. Thus, good engine speed control is always available.

BRIEF DESCRIPTION OF THE DRAWINGS

Other advantages and features of the invention will become more apparent with reference to the following detailed description of a presently preferred embodiment thereof in connection with the accompanying drawings, where like reference numerals have been applied to like elements, in which.

DETAILED DESCRIPTION

Figure 1:
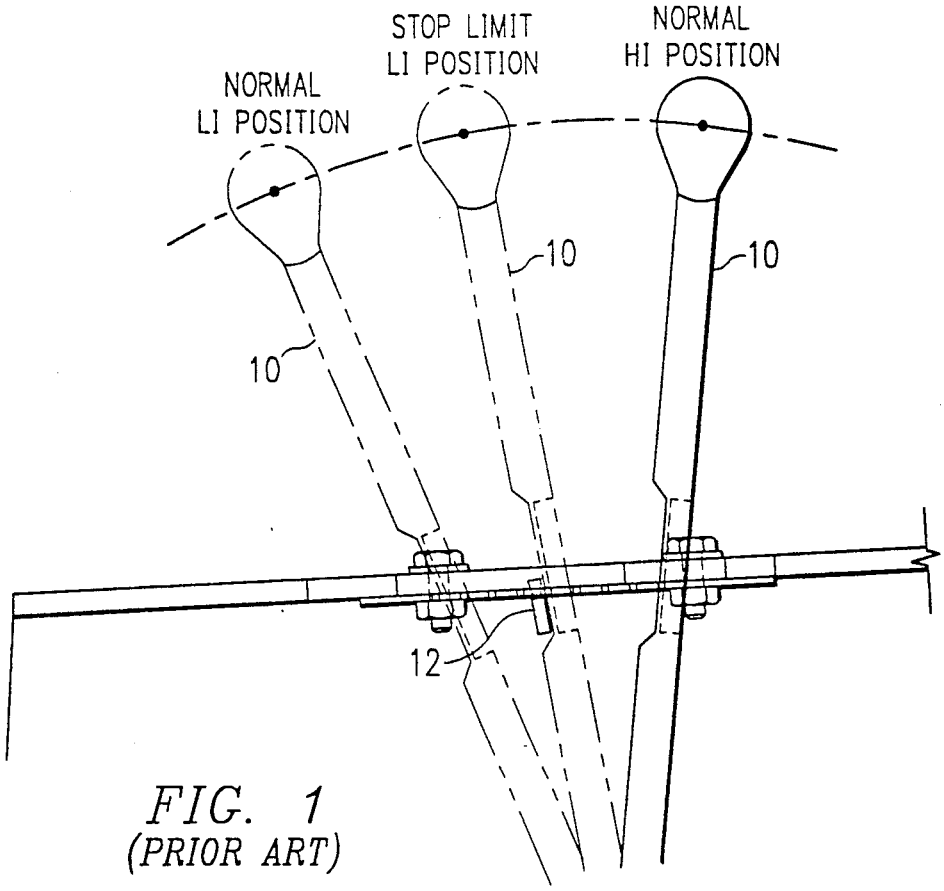
FIG. 1 (PRIOR ART)
FIG. 1 is a simplified pictorial illustrating one embodiment of the prior art throttle control lever in a throttle control linkage.
Figure 2:
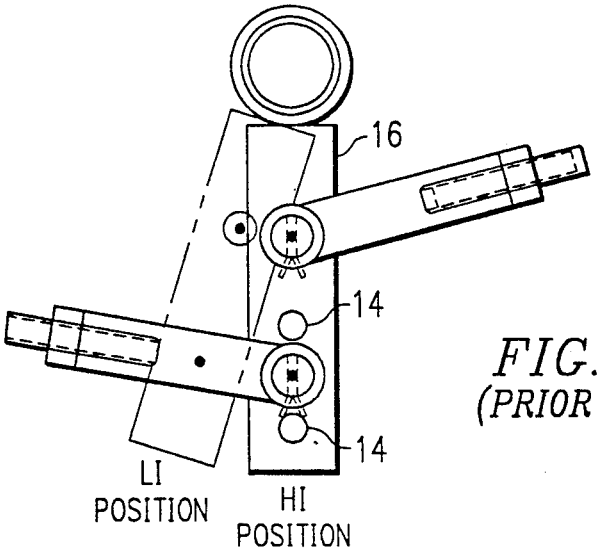
FIG. 2 (PRIOR ART)
FIG. 2 is a simplified side elevational view of a prior art bellcrank in a throttle control linkage.
Figure 3:
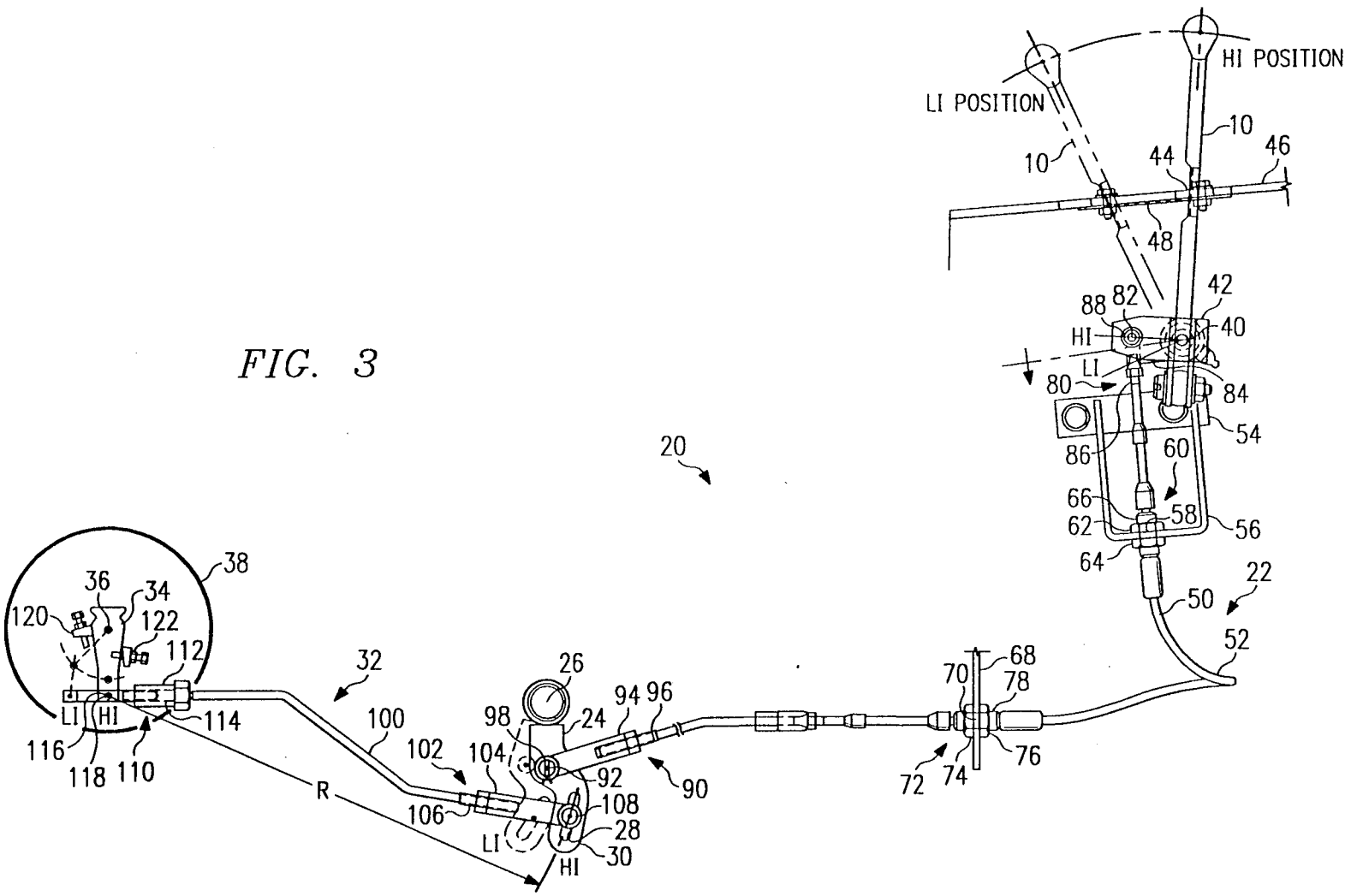
FIG. 3 is a simplified pictorial illustrating a throttle control linkage constructed in accordance with the present invention.

Referring to the drawing and to FIG. 3 in particular, shown therein and generally designated by the reference character 20 is a throttle control linkage constructed in accordance with the present invention. As illustrated, the throttle control linkage 20 comprises a throttle control lever 10 operatively connected to a predetermined end of a first linkage means 22 whose opposite or remaining end is connected to bellcrank 24, which is mounted for pivotal movement about shaft or pin 26. Bellcrank 24 includes an arcuate slot 28 formed in end portion 30 which is the end portion furthest from shaft or pin 26. Second linkage means 32 is operatively connected between arcuate slot 28 and injector lever 34 which is mounted for pivotally moving shaft 36 of fuel injector pump 38.

Throttle control lever 10 is mounted for pivotal movement on shaft 40. Shaft 40 is usually mounted on the vehicle (not shown) in which the diesel engine (not shown) is installed. It will be appreciated that throttle control lever 10 could be mounted directly to a portion of the diesel engine (not shown). First plate 42 is mounted for pivotal movement with throttle control lever 10 and can be mounted on shaft 40 or on throttle control lever 10. Throttle control lever 10 protrudes through slot 44 in mounting bracket 46. Teeth 48 protrude into slot 44 from mounting bracket 46 such that throttle control lever 10 can be moved along slot 44 and then positioned between adjacent teeth 48 for a constant setting of the throttle of the diesel engine.

In the preferred embodiment, first linkage means 22 comprises a flexible cable assembly which includes a flexible cable 50 surrounded and protected by a flexible sheath or housing 52. First mounting plate 54 is usually mounted on the vehicle (not shown). It will be appreciated that first mounting plate 54 can be mounted directly to a portion of the diesel engine (not shown). Support bracket 56 is attached to first mounting plate 54 and includes aperture 58 through which a first end 60 of sheath or housing 52 is inserted. Threaded nuts 62 and 64 combine with threaded portion 66 and support bracket 56 to secure first end 60 of sheath or housing 52 for nonmovement.

Second mounting plate 68 is usually mounted on the vehicle (not shown). It will be appreciated that second mounting plate 68 can be mounted directly to a portion of the diesel engine (not shown). Second mounting plate 68 includes aperture 70 through which the second end 72 of sheath or housing 52 is inserted. Threaded nuts 74 and 76 combine with threaded portion 78 and second mounting plate 68 to secure the second end 72 of sheath or housing 52 for non-movement.

First fastening means 80 removably attaches a first end of flexible cable 50 to first plate 42 at attachment point 82 and includes a yoke member 84 threadably attached to a first end 86 of first fastening means 80. Fastener 88 attaches yoke member 84 to first plate 42.

Second fastening means 90 removably attaches a second and opposite end of flexible cable 50 to bellcrank 24 at attachment point or aperture 92 and includes a yoke member 94 threadably attached to a first end 96 of second fastening means 90. Fastener 98 attaches yoke member 94 to attachment point or aperture 92. Bellcrank 24 is mounted for pivotal movement on shaft or pin 26 which is normally mounted to the diesel engine (not shown).

In the preferred embodiment, second linkage means 32 comprises rod 100 with third fastening means 102 attaching rod 100 to bellcrank 24. Third fastening means 102 comprises yoke member 104 threadably attached to a first end 106 of rod 100. Fastener 108 is positioned through arcuate slot 28 and attaches yoke member 104 to bellcrank 24. Fourth fastening means 110 attaches rod 100 to injector lever 34. Fourth fastening means 110 comprises yoke member 112 threadably attached to a second end 114 of rod 100. Fastener 116 attaches yoke member 112 to attachment point or aperture 118 on injector lever 34.

Stop member 120 has been installed and positioned at the factory to designate the idle or low idle or LI position of the injector lever 34 and to prevent any further motion of the injector lever 34 past the low idle position. Stop member 122 has been installed and positioned at the factory to designate the full throttle or high idle or HI position of the injector lever 34 and to prevent any further motion of the injector lever 34 past the high idle position.

In setting-up the throttle control linkage 20 to provide for a fixed amount of travel of the throttle control lever 10 to accommodate any differences in the amount of travel of injector levers 34 of different fuel injector pumps 38, throttle control lever 10 is placed or positioned in the high idle or HI position. The injector lever 34 of the particular fuel injector pump 38, which is installed on the diesel engine, is placed or positioned in the high idle or HI position against stop member 122. Fastener 108 is positioned through yoke member 104 and arcuate slot 28. Fastener 108 is left or maintained in a loose configuration in arcuate slot 28 at this time so it can move along arcuate slot 28. Arcuate slot 28 is formed in bellcrank 24 along a radius R from attachment point or aperture 118 in injector lever 34 when the throttle control lever 10 and the injector lever 34 are both positioned or located in the high idle or HI position. It will be appreciated that the length of second linkage means 32 may be adjusted by rotating either/or yoke members 104 and 112 along rod 100. It will also be appreciated that the rotational position of bellcrank 24 can be changed by rotating either/or yoke members 84 and 94 of first linkage means 22 to change the length thereof.

The throttle control lever 10 is then placed or positioned in the low idle or LI position which causes bellcrank 24 to rotate to a new position and arcuate slot 28 is no longer located on a radius R from the attachment point or aperture 118 on injector lever 34. Yoke member 104 and fastener 108 are moved along arcuate slot 28 until injector lever 34 is positioned or located in the low idle or LI position against stop member 120. Fastener 108 is then tightened against yoke member 104 and bellcrank 24 to clamp the end of second linkage means 32 at this unique position in arcuate slot 28. Now, when the throttle control lever 10 is returned to the high idle or HI position, the injector lever 34 will be correctly located in the high idle or HI position due to the fact that the arcuate slot 28 is again located on a radius about the attachment point or aperture 118 on injector lever 34.

From the foregoing detailed description, it can be appreciated that the full travel of the throttle control lever 10 is now used regardless of the amount of travel of the injector lever 34 between the high idle and low idle positions.

Although the present invention has been described with reference to a presently preferred embodiment, it will be appreciated by those skilled in the art that various modifications, alternatives, variations, etc., may be made without departing from the spirit and scope of the invention as defined in the appended claims.

We claim:

1. Throttle control linkage for an internal combustion engine having a pivotally-mounted injector lever for movement between a first predetermined position and a second predetermined position to control a fuel injector pump, said throttle control linkage comprising:

a throttle control lever mounted for movement between a first predetermined position and a second predetermined position;

a pivotally-mounted bellcrank having an arcuate slot formed therein;

first linkage means operatively connected between said throttle control lever and said pivotally-mounted bellcrank; and second linkage means operatively connected between said arcuate slot and the pivotally-mounted injector lever;

said arcuate slot formed along a predetermined radius from the connection of the second linkage means on the pivotally-mounted injector lever when said throttle control lever and said pivotally-mounted injector lever are positioned in the first predetermined position.

2. The throttle control linkage of claim 1 wherein said first predetermined position comprises a full throttle position.

3. The throttle control linkage of claim 1 wherein said second predetermined position comprises an idle position.

4. The throttle control linkage of claim 1 wherein said first linkage means comprises a flexible cable assembly.

5. The throttle control linkage of claim 1 wherein said second linkage means comprises a rod assembly including means to secure a predetermined end of said rod assembly in a predetermined location along said arcuate slot.

6. The throttle control linkage of claim 1 wherein said throttle control lever is mounted for pivotal movement.

7. In a throttle control linkage between the throttle control lever and the injector lever of a fuel injector pump for an internal combustion engine which includes a pivotally-mounted bellcrank having an arcuate slot formed therein, first linkage means operatively connected between the throttle control lever and the pivotally mounted bellcrank, second linkage means operatively connected between the arcuate slot and the injector lever, a method of setting-up the throttle control linkage to provide for a fixed amount of travel of the throttle control lever to accommodate the differences in the amount of travel of injector levers of different fuel injector pumps, said method comprising the steps of:

placing the throttle control lever in a first predetermined position;

placing the injector lever in a first predetermined position;

adjusting the length of the second linkage means so the connecting end is moveably positioned in the arcuate slot of the pivotally-mounted bellcrank; predetermined position;

placing the throttle control lever in a second predetermined position;

placing the injector lever in a second predetermined position; and clamping a connecting end of the second linkage means in said arcuate slot of the pivotally-mounted bellcrank so said connecting end does not move along said arcuate slot.

8. The method of claim 7 wherein said first predetermined position comprises a full throttle position.

9. The method of claim 7 wherein said second predetermined position comprises an idle position.

10. The method of claim 7 wherein said first linkage means comprises a flexible cable assembly.

11. The method of claim 7 wherein said second linkage means comprises a rod assembly including means to secure a predetermined end of said rod assembly in a predetermined location along said arcuate slot.

12. The method of claim 7 wherein said throttle control lever is mounted for pivotal movement.

* * * * *

UNITED STATES PATENT AND TRADEMARK OFFICE

CERTIFICATE OF CORRECTION

PATENT NO. : 5,152,268

DATED : October 6, 1992

INVENTOR(S) : Scott S. Hendron et al

It is certified that error appears in the above-identified patent and that said Letters Patent is hereby corrected as shown below:

Column 6, line 25, delete "predetermined position;".

Signed and Sealed this

Fifteenth Day of March, 1994

*Attest:*

*Attesting Officer*

Bruce Lehman

BRUCE LEHMAN

*Commissioner of Patents and Trademarks*